US006264121B1

(12) United States Patent
McClary

(10) Patent No.: US 6,264,121 B1
(45) Date of Patent: Jul. 24, 2001

(54) ADJUSTABLE HAND-HELD SHOWER APPARATUS

(76) Inventor: Nobia McClary, 1173 Chuck Dawley Blvd., Mt. Pleasant, SC (US) 29464

( * ) Notice: Subject to any disclaimer, the term of this patent is extended or adjusted under 35 U.S.C. 154(b) by 0 days.

(21) Appl. No.: 08/854,521

(22) Filed: May 13, 1997

(51) Int. Cl.[7] ..... B05B 7/02
(52) U.S. Cl. ..... 239/525; 239/587.4
(58) Field of Search ..... 239/71, 74, 75, 239/525, 562, 587.1, 587.4, 588, 447, 449, 283; 4/615, 605, 598

(56) References Cited

U.S. PATENT DOCUMENTS

| | | | | |
|---|---|---|---|---|
| 1,597,477 | * | 8/1926 | Panhorst | 239/587.4 |
| 1,985,502 | | 12/1934 | Isenberg . | |
| 2,578,587 | | 12/1951 | Palmquist et al. . | |
| 2,579,150 | | 12/1951 | Leopold et al. . | |
| 2,968,443 | | 1/1961 | Manning . | |
| 3,030,033 | | 4/1962 | Rosenkranz . | |
| 3,210,013 | | 10/1965 | Symmons . | |
| 3,420,449 | | 1/1969 | Mincielli et al. . | |
| 3,547,353 | | 12/1970 | Pecka . | |
| 4,151,957 | | 5/1979 | Gecewicz et al. . | |
| 4,161,881 | | 7/1979 | Raz . | |
| 4,210,284 | * | 7/1980 | Tarnay et al. | 239/75 |
| 4,281,543 | | 8/1981 | Raz . | |
| 4,303,201 | * | 12/1981 | Elkins et al. | 239/447 |
| 4,394,969 | * | 7/1983 | Jette | 239/414 |
| 4,497,444 | | 2/1985 | Arnold . | |
| 4,674,687 | | 6/1987 | Smith et al. . | |
| 4,880,165 | * | 11/1989 | Fuquay | 239/525 |
| 4,965,894 | * | 10/1990 | Baus | 4/605 |
| 5,160,197 | | 11/1992 | Klose . | |
| 5,172,860 | | 12/1992 | Yuch . | |
| 5,535,779 | * | 7/1996 | Huang | 137/559 |

* cited by examiner

*Primary Examiner*—Lisa Ann Douglas
(74) *Attorney, Agent, or Firm*—Harleston Law Firm; Kathleen M. Harleston

(57) ABSTRACT

A multipurpose, adjustable hand-held shower apparatus, including a pivotable shower head with an inner chamber through which water flows from an inlet to an outlet, handle-mounted controls for selecting the flow pattern and adjusting the flow rate of water to the shower head, and, if desired, an in-line temperature indicator for measuring the water temperature. The shower head pivots through a full circle (360°), allowing the user to adjust the direction of water flow to any desired angle; the controls are ergonomically positioned so that the user can quickly and easily adjust the flow pattern and intensity with one hand (the same hand with which he or she holds the apparatus).

19 Claims, 2 Drawing Sheets

ADJUSTABLE HAND-HELD SHOWER APPARATUS

BACKGROUND OF THE INVENTION

1. Field of the Invention

The present invention relates generally to shower apparatus. In particular, the present invention relates to an ergonomically-designed handheld shower apparatus with a pivotable shower head and controls for adjusting the water temperature, flow pattern, and flow rate.

2. Discussion of Background

A wide variety of shower apparatus is available, including both handheld shower heads and fixed shower heads such as are found in typical bathrooms, in many different shapes and sizes. Many factors enter into the comfort, safety, convenience, and ease of use of a shower apparatus, including the design and placement of on-off controls, temperature controls, and provisions for adjusting the intensity, direction and flow pattern of water exiting the shower head. Many shower heads are pivotable, allowing the user to direct the spray as desired. Some have only one flow pattern, allowing the user to adjust only the flow intensity; others provide several flow patterns (mist, spray, stream, pulsating, etc.). Most shower heads are designed to be attached to a fixed source of water, whether mounted to a bathroom wall or, in the case of hand-held shower heads, connected to a flexible hose leading to a bathtub faucet or other suitable source. These types of installations allow the user to adjust the intensity and temperature of the water, usually by adjusting a wall-mounted or tub-mounted faucet.

Shower apparatus with pivotable spray heads of the ball-and-socket type is disclosed by Arnold (U.S. Pat. No. 4,497,444), Symmons (U.S. Pat. No. 3,210,013), Pecka (U.S. Pat. No. 3,547,353), Rosenkranz (U.S. Pat. No. 3,030,033), Manning (U.S. Pat. No. 2,968,443), and Isenberg (U.S. Pat. No. 1,985,502). Arnold's device has a rotatable valve that permits the user to adjust the water flow rate, whereas Symmons, Pecka, Rosenkranz, and Manning use lever-type handles.

Many shower heads allow the user to adjust the water intensity and/or flow pattern. Smith, et al. (U.S. Pat. No. 4,674,687) provide a shower head constructed so as to inhibit accidental or deliberate disassembly by the user. The rings used for adjusting the spray have knurled edges for easier grasping with wet hands. Gecewicz, et al. (U.S. Pat. No. 4,151,957) use a rotatable control knob for adjusting the water flow rate, Pecka (U.S. Pat. No. 3,547,353) and Symmons (U.S. Pat. No. 3,210,013) provide lever-type handles. The Mincielli, et al. device (U.S. Pat. No. 3,420,449), intended for use by hairdressers, includes a knurled tube made of flexible plastic that contains a plurality of movable shutters. The tube is placed in-line between a conventional shower head and a faucet. Compressing the tube by hand moves the shutters to vary the size of the opening through which water flows, thereby varying the flow rate of the water.

Shower heads with shut-off valves are also known. Yucca (U.S. Pat. No. 5,172,860) discloses a hand-held shower head shaped like a cartoon figure, which includes a cut-off valve and a thermometer for reading the water temperature. Adjustments to the temperature are made at the faucet by adjusting the proportions of hot and cold water which enter the device. Rosenkranz (U.S. Pat. No. 3,030,033) includes a lever-actuated shut-off valve that allows the user to turn the water on or off without re-adjusting the desired mix of hot and cold water at the faucet. Manning's shower head has a handle for controlling fluid flow (U.S. Pat. No. 2,968,443).

It is well known that water at body temperature (about 98.6° F. or 37° C.) feels relaxing and comfortable to most people, whereas hotter water is soothing and colderwater, stimulating. However, sensitivity to water temperature varies widely from individual to individual, and water that is too hot or cold can be dangerous. Typically, infants, small children, and the elderly are more sensitive to temperature extremes than adults: temperatures that a healthy adult finds tolerable might be hot enough to scald an infant. Thus, when bathing another person, adult caregivers may find it difficult to adjust the water temperature by touch alone. In addition, the temperature of the incoming water can fluctuate widely, so that frequent checks and adjustments are needed to maintain a safe and comfortable level.

The problem of adjusting water temperature has been addressed by adding temperature indicators to shower apparatus. By way of example, Yuch's device has a thermometer mounted in the "body" of the cartoon figure (U.S. Pat. No. 5,172,860). Leopold, et al. (U.S. Pat. No. 2,579,150) place a conventional thermometer directly in the spray head of their apparatus, and Palmquist, et al. (U.S. Pat. No. 2,578,587) place athermometer in-line between the spray head and the faucet. Raz (U.S. Pat. Nos. 4,281,543 and 4,161,8812) shows a handheld shower having a rigid handle with a temperature indicator. Klose's device (U.S. Pat. No. 5,160,197) includes a battery-operated digital thermometer that can be retrofitted to an existing shower installation.

Many routine tasks are simplified by the ready availability of handheld shower apparatus: hydrotherapy, bathing an infant (or indeed, a patient of any age or physical condition), rinsing hair, etc. Furthermore, many individuals appreciate the flexibility and adjustability of such apparatus for daily use. However, whatever the type of handheld shower head is used, both hands are needed to adjust the water flow rate and/or flow pattern: one hand to hold the shower head and one hand to manipulate the controls (water flow, temperature, on-off control, etc.). This necessitates leaving a task (such as shampooing or rinsing a client's hair or bathing an infant) to adjust the shower controls. The existing practice in beauty salons, for example, is to either leave the water running while wetting, shampooing, and rinsing a client's hair, or turn the water on before each step of the process (and off after each step is completed). The first wastes both water and energy; the second wastes time as the beautician must readjust the water temperature every time she turns the water back on. Furthermore, there is no known shower apparatus which allows the user to quickly and easily, with one hand, pivot the shower head to any desired angle for use.

A problem experienced by many women (increasingly, men as well) is damaged hair. This can be caused by heat from hair dryers, curling irons, crimpers, and similar appliances. In addition, many people have their hair treated with sometimes-harsh chemicals: straighteners, permanents, conditioners, coloring agents, bleaches, and so forth. These must be thoroughly rinsed from the hair after use. If not, undesirable effects including weakening of the hair shaft, off-colors, and even hair loss may ensue. Since chemical treatments inherently weaken the hair, rinsing is preferably accomplished with a gentle spray to avoid doing additional damage to the hair. Damaged hair due to chemical treatments is a problem for many women, especially for African-American women whose hair is inherently delicate and prone to breakage. Typical hand-held shower apparatus found in beauty salons provides only one water flow pattern and lacks convenient controls for adjusting the flow rate. There is no known hand-held apparatus that permits a beautician to easily adjust the flow rate of water while rinsing a client's hair.

There is a need for a handheld shower apparatus that includes controls for adjusting the flow rate and flow pattern of water therethrough, preferably an ergonomically-designed apparatus that also allows the user to preset the water temperature only once, at the start of the working day.

SUMMARY OF THE INVENTION

According to its major aspects and broadly stated, the present invention is a multipurpose, adjustable handheld shower apparatus. The apparatus includes a handle to which is attached a pivotable shower head having an inner chamber through which water flows from an inlet to an outlet. The apparatus includes an on/off control, controls for selecting the water flow pattern and adjusting the flow rate, and, if desired, means for adjusting the water temperature. In a preferred embodiment of the invention, the controls are mounted on the handle for easy, one-handed access by the user (beautician, parent, or caregiver).

The pivotable shower head constitutes an important feature of the present invention. The shower head pivots through a full circle (360°) so that the user can quickly and easily adjust the direction of water flow depending on the task at hand: upwards, downwards, or at any desired angle. This feature gives the user more control over the direction of water flow, with greater comfort and less fatigue than is possible with conventional, fixed-position shower heads.

The ergonomic placement of the controls is another feature of the present invention. The controls are preferably mounted on the handle and positioned so that the user can quickly and easily operate them to adjust the water flow pattern and flow rate—with the same hand with which she holds the apparatus. The user does not need to pause in order to fine-tune the flow of water through the shower head; she can perform any desired adjustments with one hand while continuing to use her other hand for tasks such as supporting an infant or patient who is being bathed, rinsing a client's hair, and so forth.

Another feature of the present invention is the temperature control, which can be mounted directly on the handle or on a fitting attached to a source of water (such as a faucet with "hot" and "cold" controls). In a preferred embodiment of the invention, the temperature control allows the user to adjust the relative amounts of hot and cold water entering the apparatus. If desired, the apparatus may also include a temperature indicator. This feature allows the user to monitor the temperature simply by glancing at the indicator from time to time. This ability to "preset and forget" the water temperature allows a beautician, caregiver, or other user to concentrate on her work without stopping at intervals to test the water temperature to ensure her client's comfort and safety.

Other features and advantages of the present invention will be apparent to those skilled in the art from a careful reading of the Detailed Description of a Preferred Embodiment presented below and accompanied by the drawings.

DETAILED DESCRIPTION OF A PREFERRED EMBODIMENT

Figure 1:
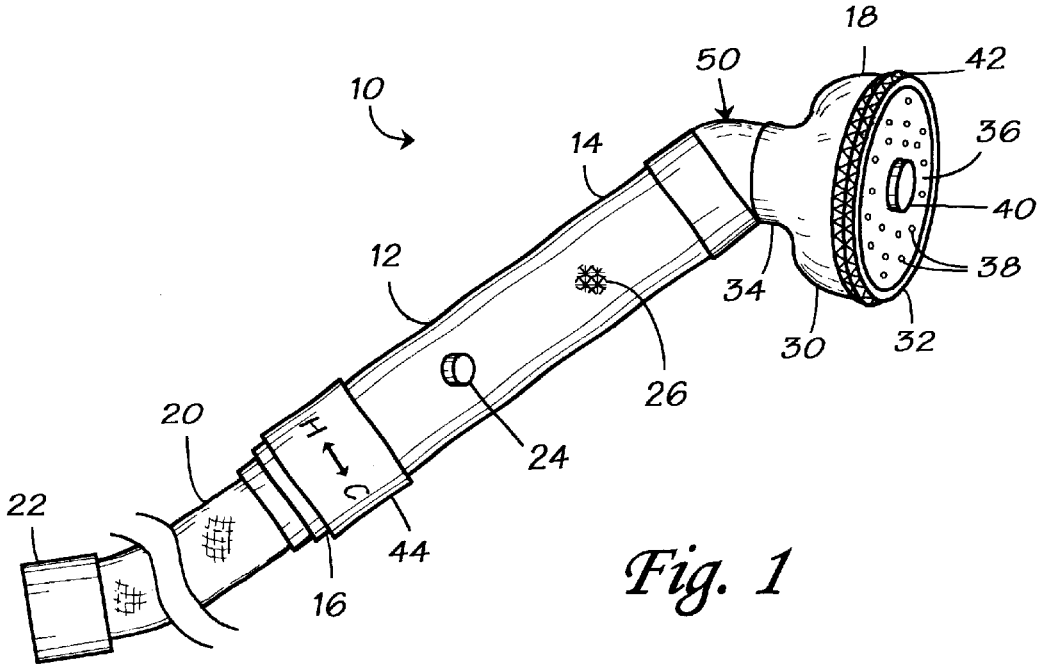
FIG. 1 is a perspective view of a handheld shower apparatus according to a preferred embodiment of the present invention.

In the following description, like reference numerals are intended to identify the same structural elements, portions or surfaces consistently throughout the several drawing figures, as such elements, portions or surfaces may be further described or explained by the entire written specification. As used in the following description, the terms "horizontal," "vertical," "left," "right," "up," "down," as well as adjectival and adverbial derivatives thereof, refer to the relative orientation of the illustrated structure as the particular drawing figure faces the reader. Similarly, the terms "inwardly" and "outwardly" refer to the orientation of a surface of revolution relative to its axis.

Referring now to FIG. 1, there is shown a perspective view of a handheld shower apparatus 10 according to a preferred embodiment of the present invention. Apparatus 10 includes a handle 12 having a first, distal end 14 and a second, proximal end 16. First end 14 is pivotally attached to a shower head 18 of any suitable type; second end 16 is attached to a flexible conduit 20. Conduit 20 terminates in a fitting 22 which can be connected to some convenient source of water. Fitting 22 may be any type of fitting that can be attached to the source of water with which apparatus 10 is used, including but not limited to a threaded fitting that can be screwed onto a faucet (or faucet adapter); alternatively, fitting 22 may be an adjustable fitting, a "quick-connect" fitting, or the type of snap-on fitting used with garden hoses. In accordance with the present invention, an in-line "on-off" control or cut-off valve 24, of any suitable type, is positioned on handle 12 for ready access by the user of apparatus 10.

Handle 12 is shaped and dimensioned to comfortably accommodate the average adult's hand, preferably, the average adult woman's hand. While women's hands tend to be somewhat smaller than men's hands, a handle that is suitable for the average woman can easily be used by the average man, whereas handles designed for men's hands may be too large for many women to use comfortably for extended periods of time. Handle 12 is typically approximately 4.0–6.0" (about 10.2–15.2 cm) long and approximately 1.0–1.5" (about 2.5–3.8 cm) in diameter. However, other sizes may also be useful, and it will be understood that the dimensions of handle 12 may vary broadly within the spirit of the present invention. Handle 12 may be generally cylindrical as shown in FIG. 1, or configured in any desired fashion for ease of use, with features such as indentations for the user's fingers. Handle 12 may have a textured, serrated, or grooved outer surface (indicated schematically at 26) to facilitate easier gripping with wet or soapy hands.

A number of shower heads, with many different designs for conditioning water flow, are suitable for use with the present invention. A suitable shower head 18 includes means for dispensing water, means adjusting the water flow pattern (spray, mist, stream, pulsating, etc.) and intensity, and so forth. By way of example, designs such as those described in U.S. Pat. Nos. 4,674,687 and 4,497,444, as well as other above-described designs and other shower heads known in the art, may be usable with the invention.

Shower head 18 preferably includes a generally hollow housing 30 with a front opening 32 and a rear opening 34. A closure 36 affixed within front opening 32 may include a plurality of outlets 38 for directing water (or other liquid) in a user-selected spray pattern outwardly from the interior of housing 30. Apparatus 10 is generally used to dispense water; however, additives such as liquid soap or shampoo, emollients, perfumes, conditioners, and medicaments may be added upstream of shower head 18 if desired. Alternatively, shower head 18 may have a single outlet such as an outlet 40 for dispensing liquid. The outer periphery of housing 30 may include a knurled ring 42, which can be rotated by the user to adjust the spray pattern and/or intensity.

Figure 2:
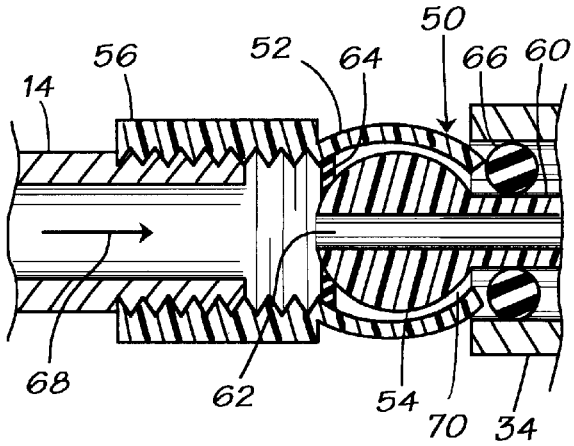
FIG. 2 is a cross-sectional view of the pivotable connector of FIG. 1 in a first position.

In a preferred embodiment of the present invention, shower head 18 is pivotally attached to first end 14 of handle 12 by a connector assembly 50 that permits rotating the shower head in a full circle (i.e., 360°) and pivoting it through an angle of approximately 15°–90°. As best seen in FIG. 2, connector assembly 50 includes a snout 52 that envelops a ball 54. An internal wall of snout 52 tapers inwardly to envelop ball 54 when a threaded end 56 of the snout is screwed onto end 14 of handle 12. Snout 52 is illustrated as being internally threaded and end 14 as externally threaded; however, it will be understood that snout 52 may be externally threaded if convenient.

A shank 60 extends from ball 54 into end 34 of shower head 18, providing a channel 62 for the flow of water into the interior of housing 30. Water flows from a source (not shown) through handle 12 and channel 62 into housing 30, where the water flow is conditioned (i.e., the flow velocity, direction, and intensity are adjusted) and the water is dispensed outwards at outlets 38 or 40 (the interior components of shower head 18 depend on the selection of shower head to be used with the invention, and thus, except as shown and described herein, do not constitute part of the present invention). Seals or gaskets 64, 66 (preferably, O-ring seals) effect sealing of ball 54 against snout 52, and of shank 60 against housing 30, respectively, thereby preventing leakage of the flowing water (indicated schematically by an arrow 68) from apparatus 10.

Figure 3:
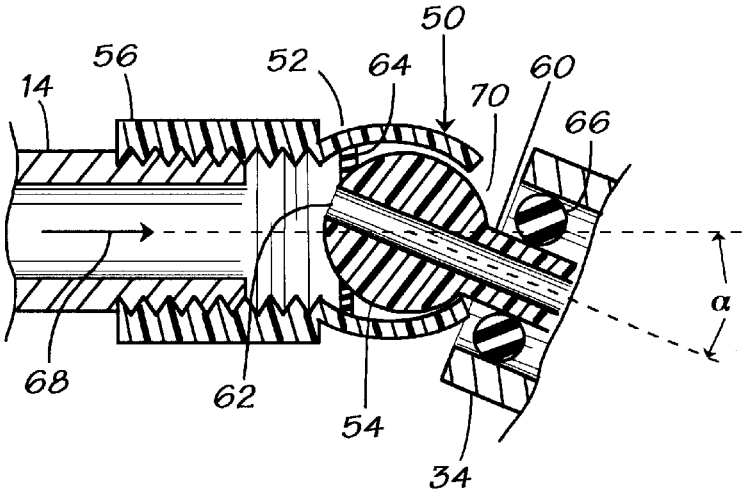
FIG. 3 shows the connector of FIG. 1 in a second position.

Connector assembly 50 is freely and continuously rotatable in a full 360° circle, allowing the user of apparatus 10 to position shower head 18 as desired for the task at hand. Ball 54 also pivots through an angle that depends on the relative dimensions of the ball and snout 52. As indicated in FIG. 3, ball 54 is freely pivotable through an angle $2\times\alpha$, where ct depends on the outer radius of shank 60 relative to an opening 70 in snout 52. Thus, the degree of pivotability of shower head 18 may be increased by decreasing the outer radius of shank 60 or by increasing the size of opening 70. Conversely, shower head 18 may be made less pivotable by increasing the radius of shank 60 or by decreasing the size of opening 70.

Apparatus 10 and shower head 18 may be made of any suitable materials. By way of example, handle 12 may be plastic or metal (aluminum, stainless steel, etc.). Shower head 18 may be made of durable plastic; however, metals such as aluminum and stainless steel may also be useful. Seals 64, 66 are natural or synthetic rubber, Teflon®, or other suitable materials.

The temperature of water entering apparatus 10 may be adjusted at the source, typically by adjusting separate "hot" and "cold" faucet controls. However, apparatus 10 may include an in-line temperature control 44, preferably positioned for easy access by the user (see FIG. 1). Temperature control 44 may take the form of a rotatable control, a slide control, or other types known in the art. When present, temperature control 44 allows the user of apparatus 10 to adjust the water temperature with the same hand with which she holds the apparatus.

Figure 4A:
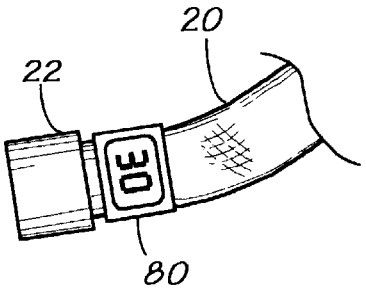
FIGS. 4A and 4B show temperature indicators positioned in accordance with the present invention.
Figure 4B:
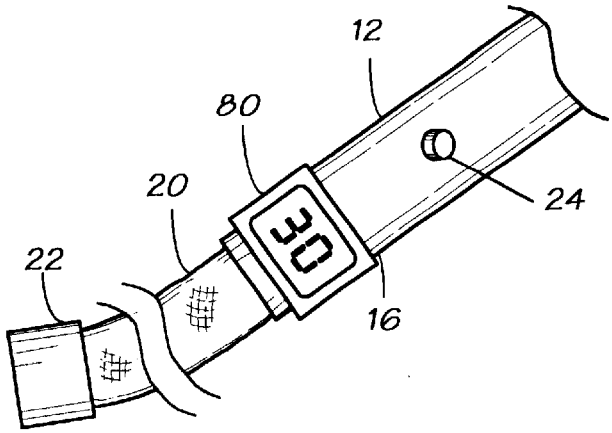

If desired, apparatus 10 may include an in-line temperature indicator 80. Indicator 80 may be positioned at fitting 22, either between fitting 22 and conduit 20 as shown in FIG. 4A, or between fitting 22 and the faucet. Alternatively, indicator 80 may be positioned at or near handle 12 (FIG. 4B). Indicator 80 provides a direct read-out of the water temperature—the user of apparatus 10 need only glance at the indicator from time to time to check that the water temperature is at the desired level. As noted above, it can at times be difficult to determine a safe and comfortable water temperature for infants, or elderly or debilitated patients, by touch alone. A direct temperature readout eliminates these difficulties and makes it easier to set the correct water temperature. Indicator 80 may have a digital read-out as shown, or an analog or other type of read-out if preferred.

Figure 5:
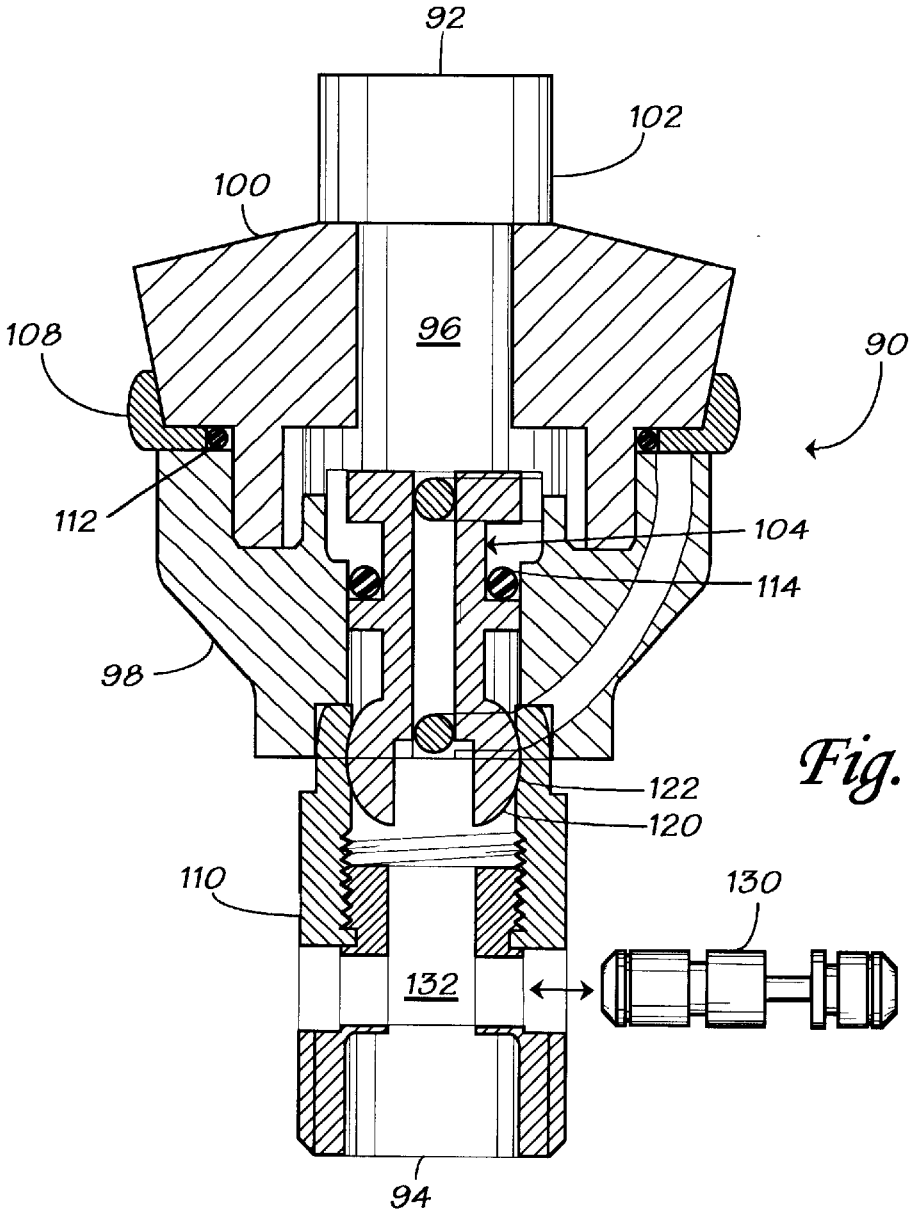
FIG. 5 is a cross-sectional view of a shower head with a pivotable connector usable with the invention.

Referring now to FIG. 5, there is shown another shower head 90 that is usable with the present invention. Shower head 90, which has a first, distal end 92 and a second, proximal end 94, is formed to direct water outwardly from an interior 96 of a spray body 98 in a user-selected spray pattern. Shower head 90 includes a direction flow body 100 terminating in a snout 102, a ball-type flow control assembly 104, a user-operable flow control ring 108, and a fitting 110 which may serve as a handle (similar to above-described handle 12). O-rings 112, 114 seal flow body 100 and ring 108 against spray body 98, and assembly 104 against spray body 98, respectively. O-rings 112, 114 permit rotation of ring 108 and pivoting of assembly 104 while preventing leakage of water from interior 96 of apparatus 90.

Flow control assembly 104 terminates in a ball 120 enveloped by a correspondingly-shaped portion 122 of fitting 110. Ball 120 is operable to pivot and/or rotate spray body 98 in a manner similar to above-described ball 54. A shut-off valve 130 is positioned across a channel 132 generally as shown (O-ring seals (not shown) may be fitted to valve 130 to help ensure a water-tight seal).

In use, second end 94, which may be internally or externally threaded, is attached to a water source (typically, a faucet with separate hot and cold water controls). When shut-off valve 130 is in the "on" or "out" position, water flows into apparatus 90, is conditioned by spray body 110 and assembly 104, and exits at end 92 in a user-selected spray pattern and intensity. When valve 130 is moved to its "off" or "in" position, valve 130 occludes channel 132 to prevent water flow through apparatus 90.

Fitting 110 may be elongated to provide a handle similar to handle 12 of above-described apparatus 10, and may be provided with a temperature indicator 80 such as that shown in FIGS. 4A and 4B. If desired, the outer surface of fitting 110 may be textured for easier gripping with wet or soapy hands.

When apparatus 10 or apparatus 90 is attached to a source of water (preferably, a source that provides both hot and cold water), the user can adjust the water temperature by simply adjusting the relative amounts of hot and cold water that enter the apparatus. Apparatus 10, 90 allows the user to "preset and forget" the water temperature at the main source (such as a faucet) at the beginning of the working day, and easily control the flow of water with on-off control 24 (or 130) using the same hand with which he or she holds the apparatus. Depending on the particular selection of shower head for the apparatus, the water flow may be varied from a gentle mist to a pulsating stream, again, with the same hand that holds apparatus 10, 90.

For beauticians in particular, an apparatus according to the present invention provides a selection of flow settings that greatly enhances their options for treating the many different types of hair encountered among their clients-this flexibility is especially useful when working with clients who have delicate hair or hair that has been damaged by prior chemical treatments (straighteners, permanents, coloring agents, etc.), heat (hair dryers, curling irons, etc.), or other factors such as chlorinated water. Furthermore, water flow can be controlled quickly and easily, with one hand (the same hand that holds the apparatus): the user can start and stop water flow, adjust the rate of flow, and adjust the flow pattern without stopping work, providing enhanced comfort and improved efficiency. Apparatus 10, 90 allows users such as beauticians, nurses, and others to concentrate on client service rather than pausing to adjust the water flow rate or spray pattern, or checking to ensure that the water is at a safe and comfortable temperature.

It will be apparent to those skilled in the art that many changes and substitutions can be made to the preferred embodiment herein described without departing from the spirit and scope of the present invention as defined by the appended claims.

What is claimed is:

1. A band-held shower apparatus, comprising:

a housing having a water inlet and an outlet;

means for attaching said inlet to a source of water;

spray means attached to said outlet, saids pray means being pivotal about a 360 degree angle so that a user can adjust the direction of water flowing from said outlet;

a handle attached to said housing;

a water cut-off valve mounted to said handle, said valve in fluid communication with said outlet;

in-line means for measuring a temperature of said water;

in line means for adjusting said temperature of said water; said means for measuring and adjusting said temperature being said spray means and said outlet; and wherein said apparatus is adapted for operation with one hand.

2. The apparatus as recited in claim 1, wherein said spray means includes means for adjusting a flow pattern of water flowing from said outlet.

3. The apparatus as recited in claim 1, wherein said means for attaching said inlet is a fitting, and said in-line means for adjusting said water temperature is a temperature control between said fitting and said handle.

4. The apparatus as recited in claim 1, said means for measuring said water temperature being a temperature indicator comprising a digital or analog readout.

5. The apparatus as recited in claim 2, further comprising a water flow control in fluid communication with said outlet, said flow control mounted to said handle for operation by a user.

6. The apparatus as recited in claim 5, further comprising a flexible conduit having a first end attached to said outlet and a second end adapted for connecting to a source of water; and temperature control means mounted to said handle, said temperature control means in fluid communication with said source for adjusting a temperature of water in said conduit.

7. The apparatus as recited in claim 5, wherein when said water cut-off valve is moved by the user to an "on" or "out" position, water flows into said apparatus from said water source, and when said water cut-off valve is moved by said user to an "off" or "in" position, said valve prevents water flow through said apparatus.

8. The apparatus as recited in claim 7, wherein said water cut-off valve can be operated with the same hand that holds said apparatus, and wherein said user can start and stop water flow, adjust rate of water flow, and adjust flow pattern during use with the same hand.

9. A hand -held shower apparatus, comprising:

a housing having an interior, a water inlet, and a water outlet;

a handle attached to said housing;

means for attaching said inlet to a source of water;

a shower head attached to said outlet, said shower head being pivotable about a 360 degree angle so that a user can adjust the direction of water flowing from said outlet; and in-line means for adjusting a temperature of said water, said in-line adjustment means being between said water inlet and said shower head.

10. The apparatus as recited in claim 9, wherein said shower head includes means for adjusting a flow pattern of water flowing from said outlet, said flow pattern adjusting means in fluid communication with said inlet and said outlet.

11. The apparatus as recited in claim 9, further comprising a water flow control with fluid communication with said outlet, said flow control mounted to said handle for one-handed operation by the user.

12. The apparatus as recited in claim 9, further comprising a water cut-off valve in fluid communication with said outlet.

13. A hand-held shower apparatus, comprising:

a housing having an interior, a water inlet, and a water outlet;

a handle attached to said housing;

means for attaching said inlet to a source of water;

a shower lead attached to said outlet said shower head being pivotable about a 360 degree angle so that a user can adjust the direction of water flowing from said outlet; and means in communication with said inlet for measuring a temperature of water entering said inlet further comprising means for adjusting a temperature of water entering said inlet, said adjusting means in fluid communication with said attaching means.

14. The apparatus as recited in claim 13, further comprising a water temperature indicator in fluid communication with said inlet, and wherein said temperature adjusting means can be controlled by said user with the same hand with which she holds said apparatus.

15. A hand-held shower apparatus for use by a beautician in rinsing a person's hair, comprising:

a housing having an interior, a water inlet, and a water outlet;

a handle attached to said housing;

a flexible conduit having a first end attached to said outlet and a second end adapted for connecting to a source of water;

a rotatable shower head attached to said outlet, said shower had being pivotal about a 360 degree angle so that said beautician can adjust the direction of water flowing from said outlet;

a water cut-off valve mounted to said handle, said valve in fluid communication with said outlet; and in-line means for adjusting a temperature of water in said flexible conduit;

wherein said shower head and said water cut-off valve can simultaneously be operated by said beautician using one hand.

16. The apparatus as recited in claim 15, wherein said shower head includes means for adjusting a flow pattern of water flowing from said outlet, said adjusting means in fluid communication with said inlet and said outlet.

17. The apparatus as recited in claim 15, further comprising means in communication with said inlet for measuring a temperature of water entering said inlet.

18. The apparatus as recited in claim 17, further comprising in-line means for measuring said water temperature mounted in said conduit between said housing and said outlet.

19. The apparatus as recited in claim 18, wherein said in-line means for adjusting said water temperature is a temperature control, and said in-line means for measuring said water temperature is a temperature indicator comprising a readout.

* * * * *